US009861552B2

(12) United States Patent
Hogan

(10) Patent No.: US 9,861,552 B2
(45) Date of Patent: Jan. 9, 2018

(54) ADHESION RELEASE MECHANISM

(71) Applicant: Michael Hogan, Santa Barbara, CA (US)

(72) Inventor: Michael Hogan, Santa Barbara, CA (US)

( * ) Notice: Subject to any disclaimer, the term of this patent is extended or adjusted under 35 U.S.C. 154(b) by 125 days.

(21) Appl. No.: 14/982,181

(22) Filed: Dec. 29, 2015

(65) Prior Publication Data

US 2017/0181922 A1 Jun. 29, 2017

(51) Int. Cl.
*A61H 15/00* (2006.01)

(52) U.S. Cl.
CPC ... *A61H 15/0092* (2013.01); *A61H 2015/005* (2013.01)

(58) Field of Classification Search
CPC ..... A61H 15/0092; A61H 2015/005
USPC ..... 601/118, 129, 131
See application file for complete search history.

(56) References Cited

U.S. PATENT DOCUMENTS 4,210,135 A * 7/1980 Deuser ..... A61H 7/003 601/129
4,712,539 A * 12/1987 Kim ..... A61H 15/0092 601/120
4,945,900 A * 8/1990 Masuda ..... A61H 15/0092 601/120
6,974,427 B1 12/2005 Lapham
2008/0103421 A1* 5/2008 Nicholson ..... A61H 15/0092 601/120
2013/0123676 A1* 5/2013 Fallstich ..... A61H 15/0092 601/118
2017/0087048 A1* 3/2017 Cohen ..... A61H 15/0092

FOREIGN PATENT DOCUMENTS

CN 88201624 U * 11/1988

* cited by examiner

*Primary Examiner* — Kristen Matter

(57) ABSTRACT

There is provided an adhesion release mechanism including a first roller having a maximum diameter d1, a second roller adjacent the first roller having a maximum diameter d2 less than d1 and d4, a third roller adjacent the second roller, the third roller having a maximum diameter d3 less than d1 and d4 and a fourth roller adjacent the third roller, the fourth roller having a maximum diameter d4. The adhesion release mechanism further includes a core structure including a longitudinal axis, the core structure configured to engage each of the rollers.

16 Claims, 7 Drawing Sheets

ADHESION RELEASE MECHANISM

FIELD OF THE INVENTION

The present application relates generally to an adhesion release mechanism. More specifically, the present application relates to an adhesion release mechanism for the self-administration of techniques and protocols related to massage therapy.

BACKGROUND

In today's ever growing sedentary society, the need for tools for relieving musculoskeletal pain, relating to the muscle and connective tissue of the body, has increased dramatically. A large portion of the population suffers from chronic pain which can be traced back to the neuromuscular system and connective tissues of the body causing the over activity of chronically tight musculature. As a result, different myofascial release and trigger point therapies have been implemented to manipulate the soft tissues (e.g., skin, muscles) and connective tissues (e.g., tendons, ligaments, and fascia) of the human body. The therapies aid in recovery following strenuous activity, recovery from musculoskeletal injury, and musculoskeletal alignment correction by restoring functional movement patterns to the body by reducing muscular tension, breaking connective tissue adhesions, and encouraging blood and lymphatic fluid circulation. Many of these therapies include the use of an apparatus, such as a foam roller, to aid in the therapeutic process, especially for self-administration of massage techniques and therapy protocols.

However, the apparatuses used for implementing these therapies are often ineffective due, in part, to the lack of contouring to the ergonomics of the human anatomy. Thus, there is a need for an adhesion release mechanism specifically designed with the ergonomics of the human anatomy in mind to provide more effective therapeutic treatment.

SUMMARY OF THE INVENTION

The following presents a general summary of aspects of the disclosure in order to provide a basic understanding thereof. This summary is not an extensive overview of the disclosure. It is not intended to identify key or critical elements of the disclosure or to delineate the scope of the disclosure. The following summary merely presents some concepts of the disclosure in a general form as a prelude to the more detailed description provided below.

In one implementation of the present disclosure, there is provided a adhesion release mechanism comprising a first roller having a maximum diameter d1; a second roller adjacent the first roller having a maximum diameter d2 less than d1 and d4; a third roller adjacent the second roller, the third roller having a maximum diameter d3 less than d1 and d4; a fourth roller adjacent the third roller, the fourth roller having a maximum diameter d4; and a core structure including a longitudinal axis, the core structure configured to engage each of the rollers, wherein d1, d2, d3, and d4 are measured normal to the longitudinal axis.

In another implementation of the present disclosure, there is provided an adhesion release mechanism comprising: a first roller having a maximum diameter d1; a second roller adjacent the first roller having a maximum diameter d2 less than d1; a third roller adjacent the second roller, the third roller having the maximum diameter d2; a fourth roller adjacent the third roller, the fourth roller having the maximum diameter d1; and a core structure including a longitudinal axis, the core structure configured to engage each of the rollers such lateral movement along the longitudinal axis is prevented, wherein d1 and d2 are measured normal to the longitudinal axis.

In yet another implementation of the present disclosure, there is provided an adhesion release mechanism comprising: a first roller having a maximum diameter d1; a second roller adjacent the first roller having a maximum diameter d2 less than d1 and d4; a third roller adjacent the second roller, the third roller having a maximum diameter d3 less than d1 and d4; a fourth roller adjacent the third roller, the fourth roller having a maximum diameter d4; a through bore extending through each of the rollers including a first longitudinal axis; and a core structure including a second longitudinal axis, the core structure configured to extend into the through bore and engage the rollers such that the first and second longitudinal axes are substantially coincident, wherein d1, d2, d3, and d4 are measured normal to the first and second longitudinal axes.

DETAILED DESCRIPTION

Figure 1:
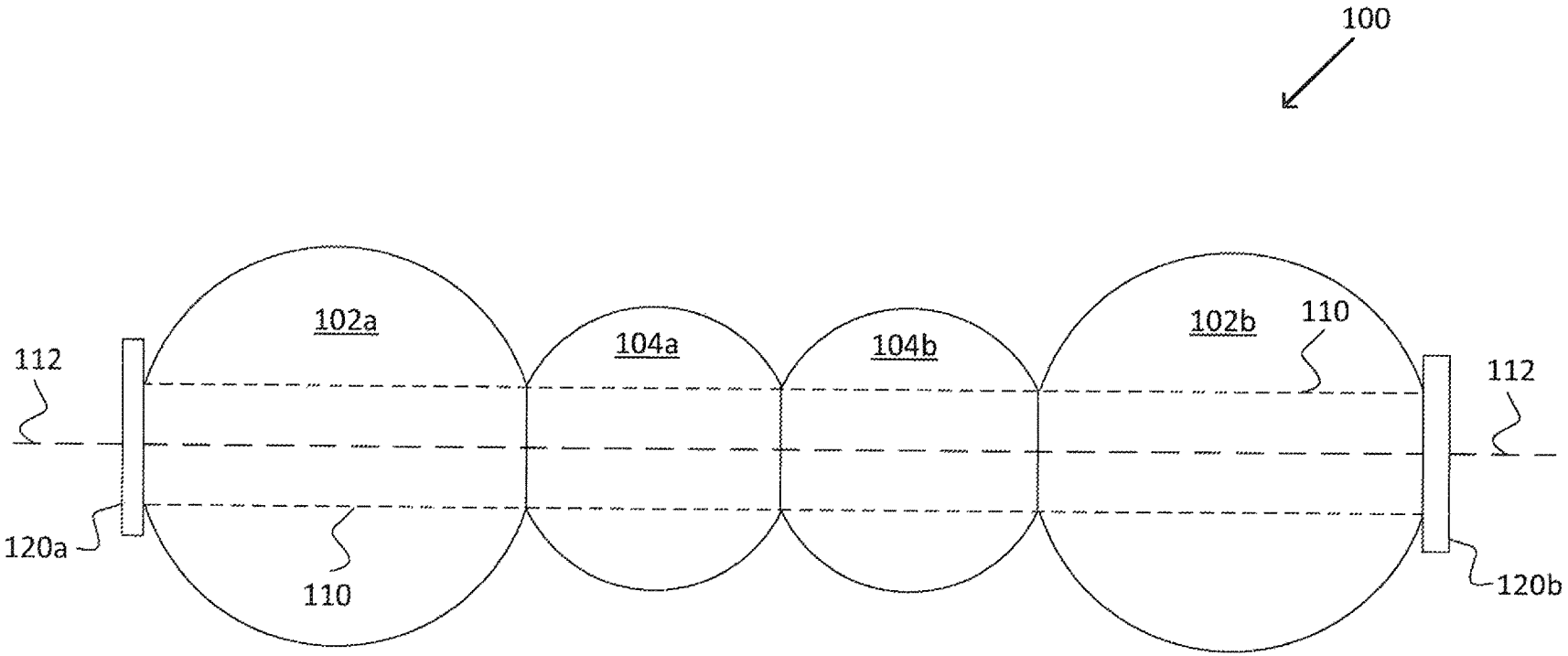
FIG. 1 illustrates a front view of an adhesion release mechanism, according to one implementation of the present disclosure.

The following description contains specific information pertaining to implementations in the present disclosure. The drawings in the present application and their accompanying detailed description are directed to merely exemplary implementations. Unless noted otherwise, like or corresponding elements among the figures may be indicated by like or corresponding reference numerals. Moreover, the drawings and illustrations in the present application are generally not to scale, and are not intended to correspond to actual relative dimensions.

FIG. 1 illustrates a front view of an adhesion release mechanism, according to one implementation of the present disclosure. Adhesion release mechanism 100 of FIG. 1 includes core structure 110, stopper 120*a*, stopper 120*b* (herein collectively referred to as stoppers 120), large roller 102*a*, large roller 102*b* (herein collectively referred to as large rollers 120), small roller 104*a*, small roller 104*b* (herein collectively referred to as small rollers 104), and longitudinal axis 112. Each of the core structure, the large rollers 102, and the small rollers 104 are described in more detail below with respect to FIGS. 2A-4B.

In one implementation, from left to right, the adhesion release mechanism 100 includes the large roller 102*a*, the small roller 104*a*, the small roller 104*b*, and the large roller 102*b*, each roller adjacent to the next. Each of the large rollers 102 may have substantially the same diameter, and each of the small rollers 104 may have substantially the same diameter. In addition, in such an implementation, the diameter of the small rollers 104 may be less than the diameter of the large rollers 102, as illustrated in FIG. 1. Such an orientation and arrangement of the large rollers 102 and the small rollers 104 creates the most effective contouring to the ergonomics of the human anatomy, especially the ergonomics of the human back, allowing the adhesion release mechanism 100 to most effectively aid in myofascial release and trigger point therapies. More specifically, the illustrated adhesion release mechanism 100 of FIG. 1 provides an ergonomic contoured fit to the vertebral column such that pressure is dispersed across the large rollers 102 when working with the spinal erector muscles, e.g. multifidus, erector spinae, longissimus, and spinal rotators. The different diameters between the large rollers 102 and the small rollers 104 provide the most effective pressure relief and adhesion separation. More specifically, the differences in diameter, specifically the smaller diameter of the small rollers 104 as compared to the large rollers 104, creates more separation and versatility in adhesion release. For example, when utilizing the adhesion release mechanism 100 in a way such that a compression is placed in the intramuscular space and a sheering force is used to pry the adhered musculature apart, an effective separation between any of the erector spinae muscles from the lamina groove, the erector spinae and the longissimus, or the trapezius from the levator scapulae and spinal erectors can be accomplished.

However, although the adhesion release mechanism 100 is pictured with the above described orientation throughout the figures, it should be noted that this illustration is not intended to limit the disclosure. As such, the small rollers 104 and the large rollers 102 may be arranged in any variety of orientations, and may include any variety of different diameters and shape profiles.

The core structure 110 is configured to provide a core to each of the small rollers 104 and the large rollers 102 such that the small rollers 104 and the large rollers 102 are connected along a unified structure and substantially restricted from lateral movement along the longitudinal axis 112. As such, the longitudinal axis 112 may define the longitudinal axis of not only the core structure 110, but also of the small rollers 104 and the large rollers 102, such that the longitudinal axes of the small rollers 104, the large rollers 102, and the core structure 110 are coincident. It should be noted that the longitudinal axes of each of the small rollers 104, the large rollers 102, and the core structure 110 are primarily coincident when the adhesion release mechanism 110 is in a relaxed position, e.g., not supporting any additional weight, such as a the weight of a human body. For example, once a weight is applied to the adhesion release mechanism 100, the adhesion release mechanism 100 may be manipulated and deform such that at least one of the core structure 110, the small rollers 102, and the large rollers 104 are subjected to a bending, torsional, compressive, tension, shear, stress, strain, point, or thrusting force which may offset the longitudinal axes of the core structure 110, the small rollers 102, and the large rollers 104 to a non-coincident position.

The core structure 110 may be a solid structure, or may be a hollow structure. The core structure 110 may be capable of bending under the forces of the load of a human body during use of the adhesion release mechanism 100, or may comprise materials restricting bending under the forces of a human body. For example, if the core structure 110 is capable of bending under the forces of the human body, the core structure 110 may comprise a composite material, such as carbon fiber, or may comprise any plastic material, or may comprise another material capable of bending under force, such as a metal. In implementations where the core structure 110 is incapable of bending, or the bending is intended to be limited, the core structure 11I 0 may comprise a metal, such as steel, aluminum, or titanium, or may comprise a hardened plastic or composite material. In such an implementation, the core structure 110 may be a solid structure, or be hollow having a large enough wall thickness to resist bending. In implementations where the core structure 110 is capable of bending, any of the above materials may be utilized for the core structure 110, with the core structure 110 being solid, or hollow with wall thicknesses of varying values, to ensure the adequate and necessary bending of the core structure 110 can be accomplished.

It should be noted that the forces of the human body during use of the adhesion release mechanism 100 include the forces exerted on the adhesion release mechanism 100 when a human lays on the adhesion release mechanism 100, including when the human supports their body with only the adhesion release mechanism 100 and their feet, for example, or when a human body rolls back and forth on the adhesion release mechanism 100. In addition, the forces of the human body may include a user of the adhesion release mechanism 100 utilizing handles to apply force to the adhesion release mechanism 100 as they massage another human body, requiring the adhesion release mechanism 100, including the core structure 110 primarily, to support the weight of a human body substantially on the ends of the core structure 110 where bending forces are maximized.

As such, for example, the adhesion release mechanism 100 may have various different core structures 110 available depending on the weight and/or size of the user, or the type of adhesion release mechanism 100 being used (e.g., handles, no handles, flexible, inflexible). In such an example, the materials, density, weight, wall thickness (if the core structure 110 is hollow), length, diameter, and other variables of the core structure 110 may be configured based on the user and adhesion release mechanism 100 information.

It should further be noted that the core structure 110 is denoted by dashed lines to illustrate the location of the core structure 110 in FIG. 1 because the core structure 110 would not be visible in the front perspective view of FIG. 1. However, if the core structure 110 extended beyond the large rollers 102 and the small roller 104, or between the large rollers 102 and the small rollers 104 in an implementation where there is spacing between any of the large rollers 102 and the small rollers 104, the core structure 110 may be visible in those regions beyond or in between the small rollers 104 and the large rollers 102. As such, where the core structure 110 extends along the longitudinal axis 112 where the small rollers 104 and the large rollers 102 are present, the core structure 110 is not visible.

The small rollers 104 and the large rollers 102 may be substantially spherical, cylindrical, rectangular, triangular, or any other suitable shape. However, the small rollers 104 and the large rollers 102 are preferably substantially spherical, as shown in each of FIGS. 1, 3A-3D, 4A-4B, and 5-6. In implementations where the large rollers 102 and the small rollers 104 are substantially spherical, the rollers have cross-sections of substantially circular shape, where the cross-sections are taken normal to the longitudinal axis 112. As such, the center of each respective roller would have a central cross-section including the maximum diameter of the respective roller, as measured normal to the longitudinal axis 112, and each subsequent cross-section taken as you move along the longitudinal axis 112 away from the central cross-section would have a decreasing diameter in comparison to the maximum diameter.

In an implementation where the small rollers 104 and/or the large rollers 102 are substantially cylindrical, the rollers would have substantially identical cross-sections at all points along the longitudinal axis 112, taken normal to the longitudinal axis 112, of circular shape each having substantially the same maximum diameter, measured normal to the longitudinal axis 112.

The small rollers 104 and the large rollers 102 may each comprise the same and/or different materials. A few exemplary materials that are suitable for the large rollers 102 and the small rollers 104 include sponge, rubber, foam, and foam rubber. However, a variety of other materials may be contemplated dependent on the given implementation of the adhesion release mechanism 100, including but not limited to metals, plastics, fabrics or combinations of any of any of the above described materials. In implementations where two or more of the large rollers 102 and the small rollers 104 comprise similar materials, for example, the two or more of the large rollers 102 and the small rollers 104 may be formed as a unitary piece, such as by co-molding, for example. As such, in some implementations, each of the small rollers 104 and the large rollers 102 may be formed as a single unitary piece for connection with the core structure 110 of the adhesion release mechanism 100. However, in other implementations, each of the small rollers 104 and the large rollers 102 may be formed individually and separately attached to each other, or individually connected to the core structure 110.

The small rollers 104 and the large rollers 102 may have a smooth, rough, and/or a textured surface. For example, the small rollers 104 and/or the large rollers 102 may have a smooth surface, such as that of a lacrosse ball. In other implementations, the small rollers 104 and/or the large rollers 102 may have a rough surface, including grooves or dimples, for example. In yet another implementation, the small rollers 104 and the large rollers 102 may have a textured surface including protrusions, for example. In such an implementations, the surface of the large rollers and/or the small rollers 104 may have rounded, triangular, rectangular, cone shaped, or any other suitable shaped protrusions extending normal to the surface of the rollers. As such, the large rollers 102 and/or the small roller 104 may each have a plurality of protrusions extending normal to the surface of the rollers and covering substantially the entire surface of the rollers.

The small rollers 104 and the large roller 102 may be solid or hollow, or a combination of both dependent on the given implementation. The small rollers 104 and the large rollers 102 may be hollow, for example, in implementations where the small rollers 104 and the large rollers 102 are expected to deform under pressure, such as the visible deformation of a tennis ball when subject to the weight of a human body. However, in implementations where the small rollers 104 and/or the large rollers 102 comprise a strong and durable material, such as a hardened plastic or metal, for example, the large rollers 102 and the small rollers 104 may be hollow to limit the amount of material used thereby decreasing overall costs of production and decreasing weight of the adhesion release mechanism 100.

Each of the small rollers 104 and the large rollers 102 may include a throughbore. The through bore is configured to allow a snug fit between the small rollers 104, the large rollers 102, and the core structure 110. As such, the diameter of the throughbore may be less than the diameter of the core structure 110 such that when the core structure 10 is inserted into the throughbore of the small rollers 104 and the large rollers 102 the small rollers 104 and the large rollers 102 are substantially restricted from lateral movement along the longitudinal axis 112 due at least in part to the elastic tension and frictional forces generated between the small rollers 104 and the large rollers 102 with the core structure 110. The throughbore will be described in greater detail below with reference to FIGS. 3A-3D.

The adhesion release mechanism 100 may further include the stoppers 120. The stoppers 120 are configured to restrict the large rollers 102 and the small rollers 104 from lateral movement along the longitudinal axis 112. In implementations where the throughbore diameter is less than the diameter of the core structure 110, the stoppers 120 provide additional resistance against lateral movement. In implementations where the large rollers 102 and the small rollers 104 are not laterally restricted, the stoppers 120 provide a restriction on the lateral movement of the large rollers 102 and the small rollers 104 along the longitudinal axis 112. The stoppers 120 may be directly adjacent and/or in contact with the ends of the core structure 110 and/or the large rollers 102 (as illustrated in FIG. 1), and/or the small rollers 104 depending on the configuration of the adhesion release mechanism 100. In some implementations, where the core structure 110 extends beyond the large rollers 102 and the small rollers 104, for example, the stoppers 120 may only be contact with the core structure 110. In some implementations, the stoppers 120, dependent on the materials of the stoppers 120 and the core structure 110, may be coupled to the core structure by an adhesive bond, welding, fusion bonding, or any other suitable method. The stoppers 120 may be circular, triangular, rectangular, or another suitable shape, so long as at least a portion of the stoppers 120 extends beyond the diameter of the core structure 110 in order to provide the necessary amount of restriction against lateral movement of the large rollers 102 and the small rollers 104. The stoppers 120 may comprise a metal, a plastic, a rubber, a composite material, or another suitable material(s).

It should be noted that the stoppers 120 are not necessary in every implementation of the present disclosure, but the stoppers 120 are preferably implemented where the large rollers 102 and the small rollers 104 are capable of at least some lateral movement along the longitudinal axis 112, especially during and/or after repeated and heavy use of the adhesion release mechanism 100. As such, the stoppers 120 may provide the most additional resistance to lateral movement along the longitudinal axis 112 after the adhesion release mechanism 100 is subjected to wear and tear over the lifetime of the adhesion release mechanism 100. The stopper 120 will be described in more detail below with reference to FIG. 2A.

Figure 2A:
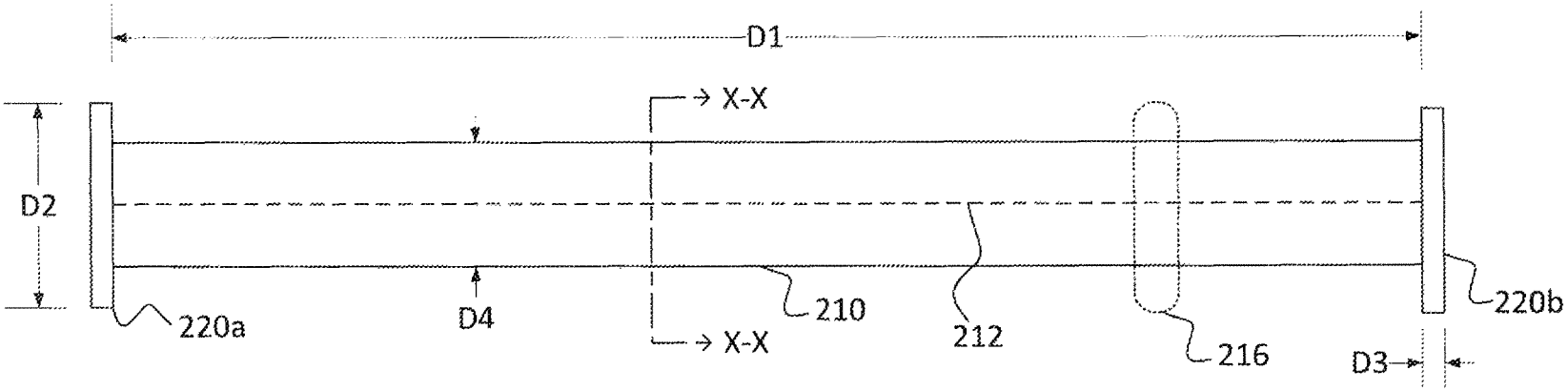
FIG. 2A illustrates a core structure of the adhesion release mechanism, according to one implementation of the present disclosure.

Now referring to FIG. 2A, FIG. 2A illustrates a core structure of the adhesion release mechanism, according to one implementation of the present disclosure. The core structure 210 includes bearing 216, longitudinal axis 212, stopper 220*a*, and stopper 220*b* (herein collectively referred to as stoppers 220). It should be noted that the core structure 210, the longitudinal axis 212, and the stoppers 220 correspond respectively to the core structure 110, the longitudinal axis 112, and the stoppers 120 of FIG. 1. It should further be noted that any reference to the small rollers, the large rollers, and the adhesion release mechanism with reference to FIGS. 2A-2D correspond respectively to the small rollers 104, the large rollers 102, and the adhesion release mechanism 100 of FIG. 1.

The core structure 210 has a length D1. The length D1 may be a variety of different lengths depending on the required implementation of the adhesion release mechanism. For example, several different sizes of the adhesion release mechanism, including the corresponding core structure 210 sizes, may be created to conform to the body shapes and sizes of various users of the adhesion release mechanism. For taller users and/or users who have wide backs, for example, the length D1 of the core structure 210 may be greater than the length D1 would be for a shorter user or a user with a more narrow body profile. As such, the length D1 of the core structure 210 is preferably between 10 and 17 inches, more preferably between 11 and 16 inches, and most preferably between 12 and 15 inches. These ranges for the length D1 of the core structure 210 provide the most comprehensive coverage of varying body types across the widest range of potential users of the adhesion release mechanism.

The core structure 210 has a distance D4 which defines the distance of the core structure 210 perpendicular to the longitudinal axis 212. The distance D4 is the distance of a cross-section of the core structure 210 taken across the cross-section X-X. The core structure 210 may take any of a variety of shapes, and thus the distance D4 may define the distance D4 of any number of cross-sectional shapes, as further illustrated and described with reference to FIGS. 2B-2D. The distance D4 is dependent on whether the core structure 210 is hollow or solid, the weight and stress carrying capacities required of the core structure 210, and the materials used in fabricating the core structure 210. For example, if the core structure is intended to be used for a smaller user with a lower weight, e.g. under 150 lbs., the distance D4 may be less as compared to if the core structure 210 is intended to be used for a larger user with a higher weight, e.g. over 200 lbs. That being said, the distance D4 is preferably between 0.5 and 1 inches, more preferably between 0.65 and 0.85 inches, and most preferably about 0.75 inches. These ranges provide a wide enough variability for use by users of varying sizes, dependent on the materials and overall structure of the core structure 210, e.g. solid or hollow.

The core structure 210 may be any cross-sectional shape capable of supporting the necessary loads of the adhesion release mechanism and capable of providing a connection between the core structure 210 and the large rollers and the small rollers such that the longitudinal axis 212 of the core structure is coincident with the longitudinal axis of the small rollers and the large rollers, as described above. For example, FIGS. 2B-2D illustrate a number of different examples of cross-sectional shapes taken along cross-section X-X illustrated in FIG. 2.

Figure 2B:
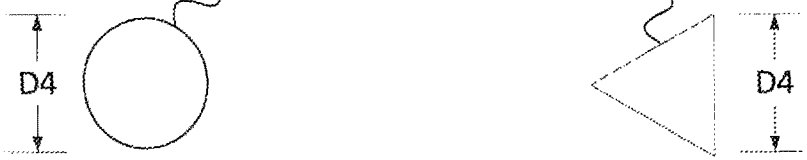
FIG. 2B illustrates a cross-sectional view of the core structure of the adhesion release mechanism, according to one implementation of the present disclosure.

FIG. 2B illustrates a circular cross-section of the core structure 210 along the cross-section X-X. The cross-section of FIG. 2B has a diameter value equivalent to that of the value of D4 described above with reference to FIG. 2A. In such an implementation, the throughbore of the large rollers and the small rollers preferably also has a circular cross-sectional shape of smaller diameter than the value D4 such that lateral movement of the large rollers and the small rollers along the longitudinal axis 212 is substantially restricted.

Figure 2C:
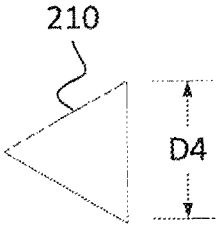
FIG. 2C illustrates another cross-sectional view of the core structure of the adhesion release mechanism, according to one implementation of the present disclosure.

FIG. 2C illustrates a triangular cross-section of the core structure 210 along the cross-section X-X. The cross-section of FIG. 2C is preferably an equilateral triangle having sides equivalent to that of the value of D4 described above with reference to FIG. 2A. In such an implementation, the throughbore of the large rollers and the small rollers preferably also has a triangular cross-sectional shape having sides of lower value than the value of D4 such that lateral movement of the large rollers and the small rollers along the longitudinal axis 212 is substantially restricted.

Figure 2D:
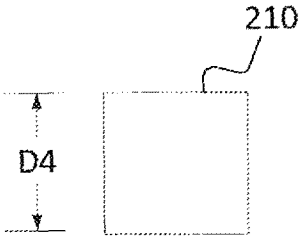
FIG. 2D illustrates another cross-sectional view of the core structure of the adhesion release mechanism, according to one implementation of the present disclosure.

FIG. 2D illustrates a rectangular cross-section of the core structure 210 along the cross-section X-X. The cross-section of FIG. 2D is preferably a square having sides equivalent to that of the value of D4 described above with reference to FIG. 2A. In such an implementation, the throughbore of the large rollers and the small rollers preferably also has a square cross-sectional shape having sides of lower value than the value of D4 such that lateral movement of the large rollers and the small rollers along the longitudinal axis 212 is substantially restricted.

The stoppers 220 are configured, as described above, to provide a restriction against the lateral movement of the large rollers and the small rollers along the longitudinal axis 212. The stoppers 220 may comprise any of a metal, a composite, a plastic, and/or a rubber material. The stoppers 220 may comprise the same material as the cores structure 210, such as when the stoppers 220 and the core structure 210 are coupled together by welding and fusion bonding, for example. However, the stoppers 220 may comprise a different material than the core structure 210, especially when the stoppers 220 are coupled to the core structure 210 by an adhesive bond, for example. The stoppers 220 have a distance D2. The distance D2 may be a diameter of the stoppers 220 if the stoppers 220 are of circular cross-section, a length of a side of a triangle if the stoppers 220 are of triangular cross-section, or a length of a side of a rectangle if the stoppers 220 are of rectangular cross-section. The distance D2 is preferably greater than the distance D4 of the core structure 210, such that the stoppers 220 are capable of providing a restriction to the lateral movement of the large rollers and the small rollers. That being said, the distance D2 of there stoppers is preferably between 0.4 and 1.1 inches, more preferably between 0.75 and 0.95 inches, and most preferably between 0.8 and 1 inches.

The core structure 210 may include the bearings 216. The bearings 216 are configured to provide an attachment between the large rollers and the small rollers to the core structure, such that the large rollers and the small rollers are capable of rotation about the longitudinal axis 212 independent of the rotation of the core structure 210 about the longitudinal axis 212. Each of the small rollers and the large rollers may have any number of the bearings 216, dependent on the size of the bearings, the size of the small rollers and the large rollers, and the necessary number of bearings for supporting the forces on the adhesion release mechanism, such as the adhesion release mechanism 100 of FIG. 1. The bearings 216 may be configured to fit snugly within the throughbore of the small rollers and the large rollers, such that lateral movement of the bearings 216 along the longitudinal axis 212 of the small rollers and the large rollers is substantially restricted. The bearings 216 may be adhesively coupled to the small rollers and the large rollers, or may be held in place by frictional and pressure forces in implementations where the outer diameter of the bearings 216 is greater than that of the throughbore of the small rollers and the large rollers. The bearings 216 additionally include a throughbore for attachment to the core structure 210. The bearings 216 may be attached to the core structure by an adhesive, for example. The bearings 216 may be ball bearings, roller bearings, ball thrust bearings, roller thrust bearings, tapered roller bearings, or any other suitable type of bearings.

Figure 3B:
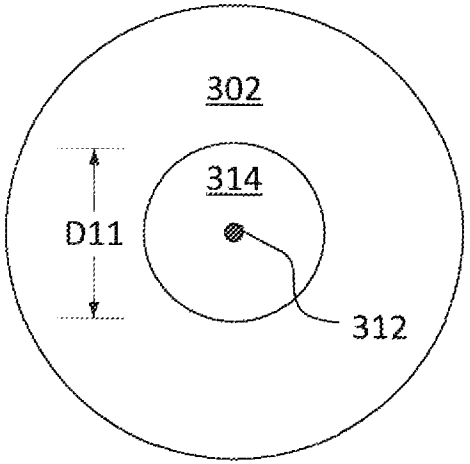
FIG. 3B illustrates a side view of the roller of FIG. 3A, according to one implementation of the present disclosure.
Figure 3A:
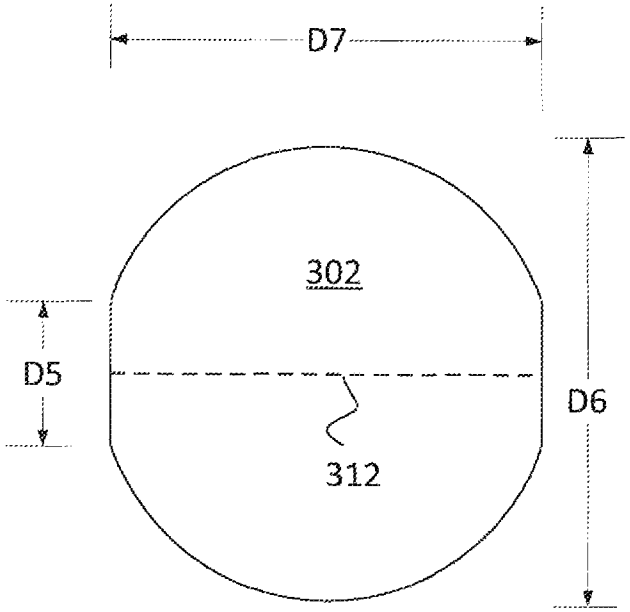
FIG. 3A illustrates a roller of the adhesion release mechanism, according to one implementation of the present disclosure.

Now referring to FIG. 3A, FIG. 3A illustrates a roller of the adhesion release mechanism, according to one implementation of the present disclosure. FIG. 3A includes the large roller 302 and the longitudinal axis 312 which correspond respectively to the large roller 102 and the longitudinal axis 312 of FIG. 1.

As illustrated in FIG. 3A and FIG. 1, the large roller 302 has blunted ends defined by the distance D5. The distance D5 may be a diameter of the throughbore extending through the large roller 302, or may be the distance D5 of the blunted end of the large roller 302. Where the distance D5 is the not the distance D5 of the throughbore, the throughbore distance measurement, such as distance D11 of FIG. 3B, is less than the distance D5 of the throughbore. The distance D5 may be the diameter of the throughbore if the throughbore is of circular cross-section, a length of a side of a triangle if the throughbore is of triangular cross-section, or a length of a side of a rectangle if the throughbore is of rectangular cross-section. In implementations where the distance D5 is not the distance of the throughbore, the distance D5 is designed to provide the proper separation between the large rollers 302 and the small rollers, such as small rollers 104 of FIG. 1. For example, if a larger separation between the large rollers 302 and the small rollers is required, the distance D5 is likely equivalent to the throughbore distance D11 of FIG. 3B, or only incrementally greater, such as 0.01 inches greater. However, if less separation is required between the large rollers 302 and the small rollers, such as for a smaller user, e.g. a user with a less wide back, the distance D5 may be more substantial in comparison to the distance D11 of the throughbore, as discussed in further detail below with respect to FIG. 3B. That being said, the distance D5 is preferably between 0.6 and 1 inches, more preferably between 0.7 and 0.9 inches, and most preferably between 0.75 and 0.85 inches. These ranges provide values within and outside of the ranges of the distance D11 of the throughbore while providing the necessary ranges of separation between the large rollers 302 and the small rollers such that users of varying sizes can effectively utilize the adhesion release mechanism, such as the adhesion release mechanism 100 of FIG. 1.

The distance D7 of the large roller 302 is determined as a result of the diameter D6 and the distance D5, both discussed above. For example, when the diameter D6 is larger and the distance D5 is less, the distance D7 is greater. However, as the diameter D6 decreases and/or the distance D5 is increased, the value of the distance D7 decreases. As a result, the distance D7 is configured around the design requirements of the distance D5 and the diameter D6 of the large roller 302.

The diameter D6 of the large roller may vary dependent on the size of the user, as discussed above. However, the diameter D6 is designed to be greater than the diameter of the small rollers of the adhesion release mechanism, such that the most effective separation and versatility in adhesion release is achieved. That being said, the diameter D6 is preferably between 2.5 and 4.75 inches, more preferably between 3 and 4.25 inches, and most preferably between 3.25 and 4 inches. These ranges of the diameter D6 provide a large enough increase over the diameter of the small rollers, as will be described below with respect to FIGS. 3C-3D, to allow the necessary prying apart of adhered musculature, while still allowing room for the diameter of the small rollers to be large enough to allow the throughbore of the small rollers to receive the core structure, such as core structure 110 of FIG. 1.

FIG. 3B illustrates a side perspective view of the roller of FIG. 3A, according to one implementation of the present disclosure. FIG. 3B includes the large roller 302, the longitudinal axis 312 and the throughbore 314. It should be noted that the large roller 302 and the longitudinal axis 312 correspond respectively to the large roller 302 and the longitudinal axis 312 of FIG. 3A.

The large roller 302 of FIG. 3B includes the throughbore 314. The throughbore 314 extend entirely through the large roller 302 having a central axis coincident with the longitudinal axis 312, which corresponds to the longitudinal axis 112 of the adhesion release mechanism 100 of FIG. 1. The throughbore 314 is configured for attachment to the core structure of the adhesion release mechanism, and is preferably configured to have a distance D11 less than the distance D4 of the core structure, as described above with respect to FIG. 2A. The throughbore 314 has the distance D11 which may the distance of a diameter of the throughbore 314 if the throughbore is of circular cross-section, as illustrated in FIG. 3B, the distance of a side of a triangle if the throughbore 314 is of triangular cross-section, or the distance of a side of a rectangular if the throughbore 314 is of rectangular cross-section. The distance D11 is preferably between 0.45 and 0.95 inches, more preferably between 0.6 and 0.8 inches, and most preferably about 0.735 inches. These ranges provide for the necessary fit between the core structure and the large roller 302 such that lateral movement along the longitudinal axis 312 is substantially restricted due to the frictional and pressure forces created between the core structure and the throughbore 314 of the adhesion release mechanism.

Figure 3D:
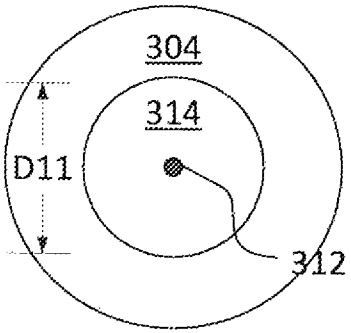
FIG. 3D illustrates a side view of the roller of FIG. 3C, according to one implementation of the present disclosure.
Figure 3C:
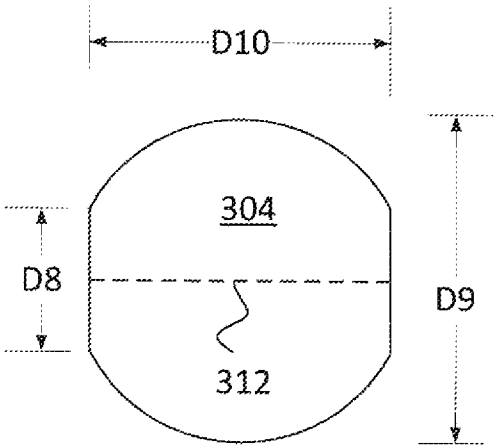
FIG. 3C illustrates another roller of the adhesion release mechanism, according to one implementation of the present disclosure.

FIG. 3C illustrates another roller of the adhesion release mechanism, according to one implementation of the present disclosure. FIG. 3C includes the small roller 304 and the longitudinal axis 312 which correspond respectively to the small roller 104 and the longitudinal axis 112 of FIG. 1.

It should further be noted that the value D8 is preferably identical to the value of D5 of FIG. 3A, which is the distance of the blunt end of the large roller. As illustrated in FIG. 1, the large rollers and the small rollers have substantially matching blunt end heights. This is especially important in implementations where the large rollers and the small rollers are formed in as a single unified piece prior to attachment to the core structure. More specifically, if the large rollers and the small rollers are formed as one unitary piece, it is more cost effective to manufacture the small rollers and the large rollers to have identical blunt end heights, D5 and D8. As such, the values of D8 are preferably between 0.6 and 1 inches, more preferably between 0.7 and 0.9 inches, and most preferably between 0.75 and 0.85 inches As explained with respect to the value of D7 of FIG. 3A, the value of D10 is similarly a result of the design parameters of the blunt end height D8 and the diameter D9 of the small roller 304. In addition, the value of D10 changes in a similar fashion with respect to the distance D8 and the diameter D9, as the value of D5 changes with respect to the distance D5 and the diameter D6.

The diameter D9 of the small roller 304 is determined with respect to the diameter D6 of the large roller such that effective adhesion release and prying apart of adhered musculature is accomplished. As such, the diameter D9 of the small roller 304 is preferably between 2 and 4 inches, more preferably between 2.5 and 3.75 inches, and more preferably between 2.75 and 3.5 inches. These ranges allow for the throughbore 314 of FIG. 3D, which corresponds to the throughbore 314 of FIG. 3B, to be manufactured through the small roller 304 to provide adequate amounts of material outside of the diameter D11 of the throughbore for the adhesion release mechanism to function correctly while also allowing adequate space of the core structure to engage the small roller 304 and still provide adequate durability during use.

The ratio between D6 and D9 is important for enabling an effective separation between any of the erector spinae muscles from the lamina groove, the erector spinae and the longissimus, or the trapezius from the levator scapulae and spinal erectors when utilizing the adhesion release mechanism in a way such that a compression is placed in the intramuscular space and a sheering force is used to pry the adhered musculature. The ranges of values for D6 and D9 are necessary in order for the adhesion release mechanism to work effectively across users of different sizes. As such, the ratio D6/D9 is preferably between 1.1 and 1.25, more preferably between 1.13 and 1.2, and most preferably between 1.14 and 1.18. Thus, the adhesion release mechanism may be offered in varying sizes including a range of different rollers having varying diameters D6 and D9, but across each size, the ratio D6/D9 is preferably within the above outlined ranges in order to provide effective separation between any of the erector spinae muscles from the lamina groove, the erector spinae and the longissimus, or the trapezius from the levator scapulae and spinal erectors, for example. Additionally, the values outlined above for D6/D9 are necessary for dispersal of pressure away from the vertebral column when used in spinal applications, such as paraspinal adhesion to the lamina groove, because greater pressure is applied to the regions of the back in contact with the large rollers 302 having diameter D6 while the vertebral column has reduced pressure due to the diameter D9 of the small roller 304.

FIG. 3D illustrates a side perspective view of the roller of FIG. 3C, according to one implementation of the present disclosure. FIG. 3D includes the small roller 304, the longitudinal axis 312, and the throughbore 314. It should be noted that the small roller 304 and the longitudinal axis 312 of FIG. 3D correspond respectively to the small roller 304 and the longitudinal axis 312 of FIG. 3C. It should further be noted that the throughbore 314 of FIG. 3D corresponds respectively to the throughbore 314 of FIG. 3B.

The throughbore 314 of the small roller 304 has a distance value D11. It should be noted that because the throughbore 314 of the small roller 304 corresponds to the throughbore 314 of the large roller, the distance D11 is substantially identical to the distance D11 of FIG. 3B.

Figure 4B:
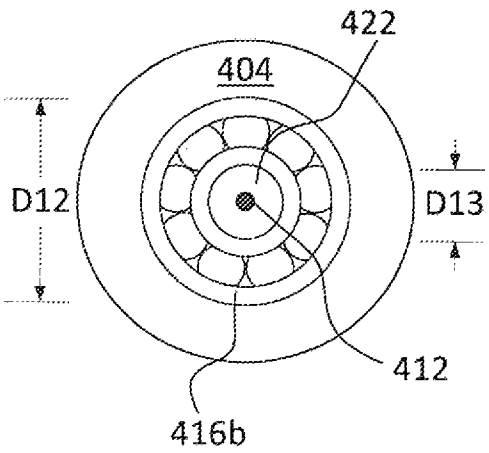
FIG. 4B illustrates another roller of the adhesion release mechanism including a bearing, according to one implementation of the present disclosure.
Figure 4A:
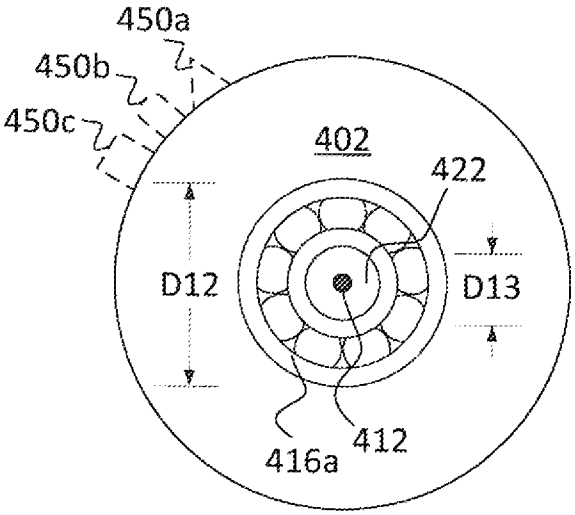
FIG. 4A illustrates another roller of the adhesion release mechanism including a bearing, according to one implementation of the present disclosure.

FIG. 4A illustrates another roller of the adhesion release mechanism including a bearing, according to one implementation of the present disclosure. FIG. 4A includes the large roller 402, the throughbore 422, the bearing 416*a*, and the longitudinal axis 412. It should be noted that the longitudinal axis 412 corresponds to the longitudinal axis 112 of FIG. 1. It should further be noted that the bearing 416*a* corresponds to the bearing 216 of FIG. 2A.

The bearing 416*a* may be any type of bearing, similar to those described above with respect to the bearing 216 of FIG. 2A. The bearing 416*a* may fit within the throughbore of the large roller 402, which may correspond to the throughbore 314 of FIG. 3B. As such, the distance D12 of the bearing 416*a* is designed to be greater than the distance D11 of the throughbore of the large roller such that the bearing 416*a* fits securely within the throughbore of the large roller, such that lateral movement of the bearing 416*a* along the longitudinal axis 412 is substantially restricted.

The bearing may also have a throughbore 422 which is configured for attachment to the core structure of the adhesion release mechanism, such as the core structure 110 of the adhesion release mechanism 100 of FIG. 1. In such an implementation, the core structure distance, such as distance D4 of FIG. 2, is substantially less than in implementations without bearings 416*a* because the bearings 416*a* are capable of supporting some of the loads and forces on the adhesion release mechanism during use of the adhesion release mechanism. That being said, the distance D13 of the throughbore 422 is preferably about ¾ of the distance ranges D11 of the throughbore of FIG. 3B, as described above.

The large roller 402 is also illustrated as having protrusions 450*a*, 450*b*, and 450*c* (herein collectively referred to as protrusions 450). The protrusions may be of varying shapes, including triangular, rectangular, and circular. The protrusions are explained in more detail above with reference to FIG. 1. It should be noted that the protrusions 450 are illustrated with dashed lines as they are included as merely illustrative examples, and are not required in every implementation of the present disclosure. In addition, the protrusions are only illustrated in FIG. 4A on the large roller 402, but may also be included on any of the rollers, including the small roller 404 of FIG. 4B, or any of the small roller 104 and large rollers 102 discussed above with reference to FIG. 1.

FIG. 4B illustrates another roller of the adhesion release mechanism including a bearing, according to one implementation of the present disclosure. FIG. 4B includes the small roller 404, the throughbore 422, the bearing 416*b*, and the longitudinal axis 412. It should be noted that the longitudinal axis 412 corresponds to the longitudinal axis 112 of FIG. 1. It should further be noted that the bearing 416*b* corresponds to the bearing 216 of FIG. 2A and the throughbore 422 corresponds to the throughbore 422 of FIG. 4A.

The bearing 416*b* may be an identical bearing to the bearing 416*a* of FIG. 4A, such that the distances D12 and D13 are substantially identical.

Figure 5:
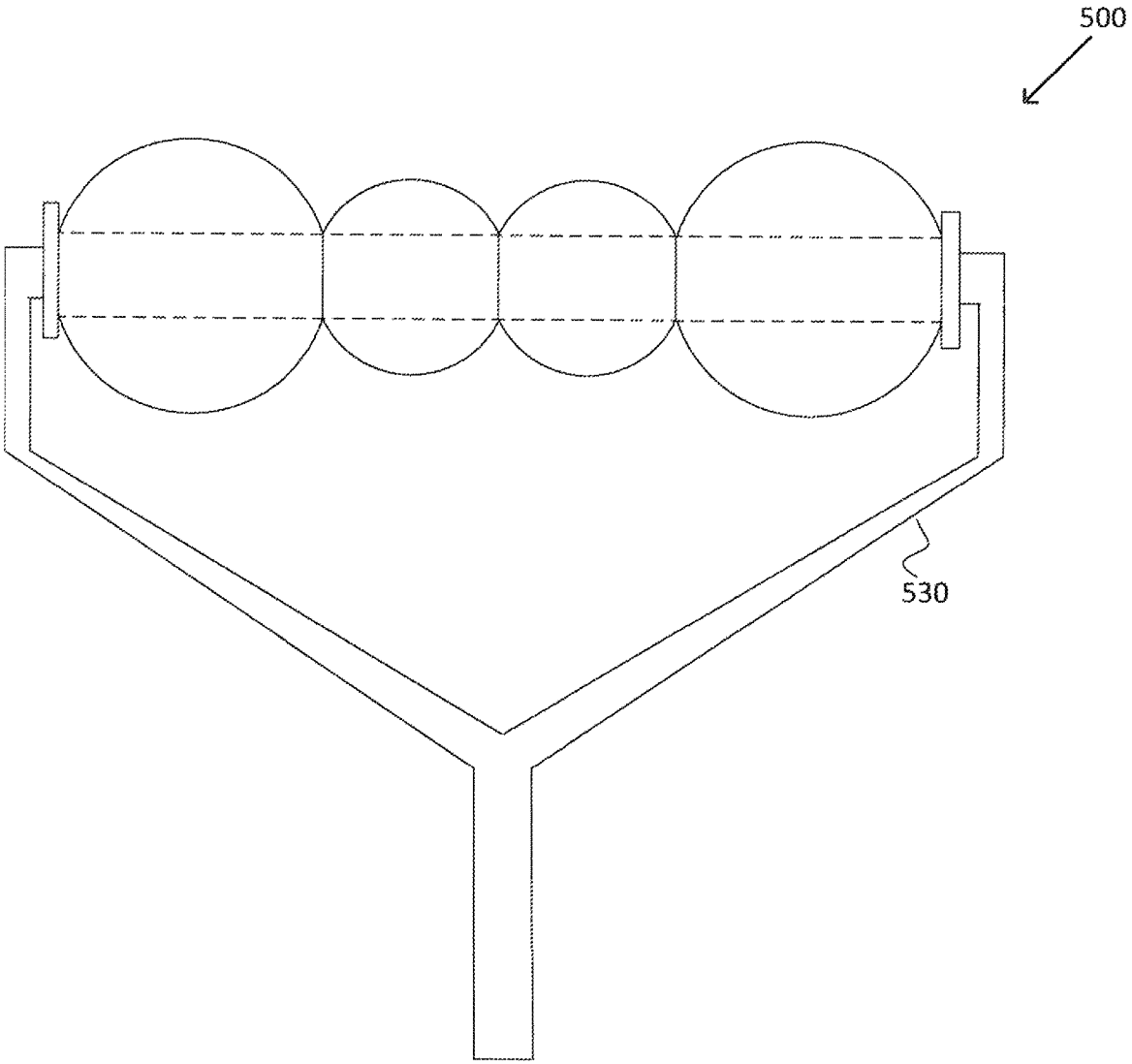
FIG. 5 illustrates a handle configuration for use with the adhesion release mechanism of FIG. 1, according to one implementation of the present disclosure.

FIG. 5 illustrates a handle configuration for use with the adhesion release mechanism of FIG. 1, according to one implementation of the present disclosure. The adhesion release mechanism 500 of FIG. 5 includes the handle 530. It should be noted that the adhesion release mechanism 500 includes the adhesion release mechanism 100 of FIG. 1 but additionally includes the handle 530.

The handle 530 may be utilized to allow a user, other than the person receiving the treatment with the adhesion release mechanism 500, to have a strong grip on the adhesion release mechanism 500 in order to adequately control the adhesion release mechanism 500.

Figure 6:
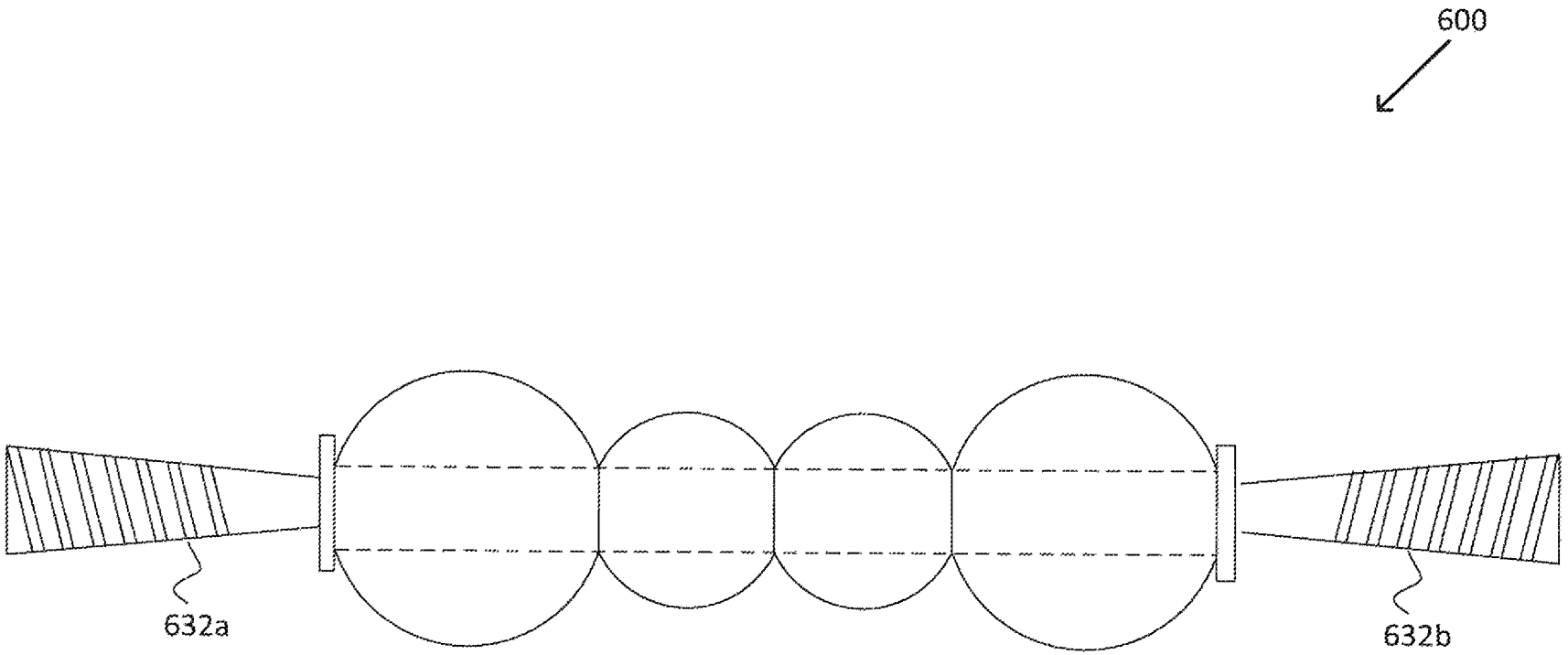
FIG. 6 illustrates another handle configuration for use with the adhesion release mechanism of FIG. 1, according to one implementation of the present disclosure.

FIG. 6 illustrates another handle configuration for use with the adhesion release mechanism of FIG. 1, according to one implementation of the present disclosure. The adhesion release mechanism of FIG. 6 includes the handle 632*a* and the handle 632*b* (herein referred to as the handles 632). It should be noted that the adhesion release mechanism 600 includes the adhesion release mechanism 100 of FIG. 1 but additionally includes the handles 632.

The handle 632 may be utilized to allow the user of the adhesion release mechanism to manipulate and maneuver the adhesion release mechanism 600 so that the adhesion release mechanism 600 is in the proper position relative to the user. In addition, the handles 632 may be utilized to allow a user, other than the person receiving the treatment with the adhesion release mechanism 600, to have a strong grip on the adhesion release mechanism 600 in order to adequately control the adhesion release mechanism 600.

In use, the adhesion release mechanism discussed above is positioned in direct contact between the body of the user of the adhesion release mechanism and a rigid surface, e.g. a floor or wall, and the desired pressure may be exerted to identified areas of tight musculature, trigger points, restriction and adhesion found in the soft and connective tissues of the body.

From the above description it is manifest that various techniques can be used for implementing the concepts described in the present application without departing from the scope of those concepts. Moreover, while the concepts have been described with specific reference to certain implementations, a person of ordinary skill in the art would recognize that changes can be made in form and detail without departing from the scope of those concepts. As such, the described implementations are to be considered in all respects as illustrative and not restrictive. It should also be understood that the present application is not limited to the particular implementations described above, but many rearrangements, modifications, and substitutions are possible without departing from the scope of the present disclosure.

What is claimed is:

1. An adhesion release mechanism comprising:

a first substantially spherical roller having a maximum diameter d1 between 3.25 inches and 4 inches;

a second substantially spherical roller adjacent the first roller having a maximum diameter d2 between 2.75 inches and 3.5 inches, wherein d2 is less than d1;

a third substantially spherical roller adjacent the second roller, the third roller having a maximum diameter d3 substantially equal to d2;

a fourth substantially spherical roller adjacent the third roller, the fourth roller having a maximum diameter d4 substantially equal to d1; and a core structure having a length between 12 inches and 15 inches and having a longitudinal axis, the core structure configured to engage each of the first, second, third, and fourth rollers, wherein:

d1, d2, d3, and d4 are measured normal to the longitudinal axis; and each of the first, second, third, and fourth rollers have a textured outer surface including grooves.

2. The adhesion release mechanism of claim 1, further comprising stoppers at each end of the core structure for preventing lateral movement of the rollers along the longitudinal axis of the core structure.

3. The adhesion release mechanism of claim 1, wherein each of the first, second, third, and fourth rollers are separately formed.

4. The adhesion release mechanism of claim 1, wherein the core structure comprises one of rubber, metal, plastic, and composite.

5. The adhesion release mechanism of claim 1, wherein the rollers comprise at least one of rubber, and plastic.

6. The adhesion release mechanism of claim 1, wherein the textured outer surface of each of the rollers is substantially identical.

7. The adhesion release mechanism of claim 1, wherein the textured outer surface of at least one of the rollers includes a plurality of rounded protrusions.

8. The adhesion release mechanism of claim 1, wherein a diameter of the core structure is between 0.5 and 1 inch.

9. The adhesion release mechanism of claim 1, further comprising ball bearings configured to provide engagement between the core structure and the rollers such that the rollers can rotate independently of the core structure.

10. An adhesion release mechanism comprising:

a first substantially spherical roller having a maximum diameter d1 between 3.25 inches and 4 inches;

a second substantially spherical roller adjacent the first roller having a maximum diameter d2 between 2.75 inches and 3.5 inches, wherein d2 is less than d1;

a third substantially spherical roller adjacent the second roller, the third roller having the maximum diameter d2;

a fourth substantially spherical roller adjacent the third roller, the fourth roller having the maximum diameter d1; and a core structure including a longitudinal axis, the core structure configured to engage each of the rollers such that lateral movement of each of the rollers along the longitudinal axis is prevented, wherein d1 and d2 are measured normal to the longitudinal axis.

11. The adhesion release mechanism of claim 10, wherein the ratio d1/d2 is between 1.1 and 1.25.

12. The adhesion release mechanism of claim 10, wherein an outer surface of each of the rollers includes a plurality of rounded grooves.

13. The adhesion release mechanism of claim 10, wherein the ratio d1/d2 is between 1.1 and 1.25.

14. An adhesion release mechanism comprising:

a first substantially spherical roller having a maximum diameter d1 between 3.25 inches and 4 inches;

a second substantially spherical roller adjacent the first roller having a maximum diameter d2 between 2.75 inches and 3.5 inches, wherein d2 is less than d1;

a third substantially spherical roller adjacent the second roller, the third roller having a maximum diameter d3 substantially equal to d2;

a fourth substantially spherical roller adjacent the third roller, the fourth roller having a maximum diameter d4 substantially equal to d1;

through bores extending through each of the rollers having a diameter d5, each of the through bores having a roller longitudinal axis; and a core structure having a diameter d6 greater than d5, the core structure including a core longitudinal axis and configured to extend into each of the through bores and engage the rollers such that the core longitudinal axis and each of the roller longitudinal axes are substantially coincident, wherein d1, d2, d3, d4, and d5 are measured normal to each respective roller longitudinal axes and d6 is measured normal to the core longitudinal axis.

15. The adhesion release mechanism of claim 14, wherein a diameter of each through bore is less than the diameter of the core structure such that the core structure securely engages the rollers.

16. The adhesion release mechanism of claim 14, wherein the ratio d1/d2 is between 1.1 and 1.25.

* * * * *